US005326577A

United States Patent [19]

Warnock

[11] Patent Number: 5,326,577

[45] Date of Patent: Jul. 5, 1994

[54] SHRINK WRAP PACKAGE FOR FRAGILE FOOD PRODUCTS

[75] Inventor: Donald G. Warnock, Madera, Calif.

[73] Assignee: Warnock Food Products, Inc., Madera, Calif.

[21] Appl. No.: 955,657

[22] Filed: Oct. 2, 1992

[51] Int. Cl.[5] ..... B65D 85/30

[52] U.S. Cl. ..... 426/124; 426/128; 426/396

[58] Field of Search ..... 426/106, 124, 128, 396; 206/45.31, 45.32, 495, 499, 521.1, 585, 45.33, 459.5, 492, 497; 229/87.08, 938; 53/157, 238, 445, 474

[56] References Cited

U.S. PATENT DOCUMENTS 2,654,970 10/1953 Miller .
3,896,928 7/1975 Forte .
4,018,905 4/1977 Adamack et al. .
4,230,258 10/1980 Lane .
4,299,850 11/1981 Wallen et al. .
4,300,683 11/1981 Roccaforte .
4,381,837 5/1983 Cortopassi .
4,496,354 1/1985 Steer .
4,697,707 10/1987 Engdahl .
4,873,099 10/1989 Ruiz ..... 426/106
4,944,389 7/1990 Robertson .
5,020,669 6/1991 Nakagoshi .
5,087,498 2/1992 Nedblake et al. ..... 426/124

*Primary Examiner*—Michael W. Ball
*Assistant Examiner*—Richard Caspino
*Attorney, Agent, or Firm*—Price, Gess & Ubell

[57] ABSTRACT

A packaging assembly for packaging brittle food products such as taco shells and tostada bowls is provided. The package has a generally L-shaped backing assembly into which the food product is inserted. A transparent overwrap covers the entire package. The L-shaped cardboard backing assembly is a three-layer cardboard assembly having an inner corrugated cardboard layer and top and bottom thin cardboard layers with the top and bottom thin layers preferably capable of receiving printed graphics. In a preferred embodiment, the upper and lower thin cardboard layers are formed from a single unitary cardboard sheet which is folded over onto the corrugated sheet to form a sandwich-type three-layer structure. The resulting package supports and protects the tortilla products from damage, yet allows a substantial portion of the tortilla products to be viewed by a consumer, allowing the consumer to quickly verify that the tortilla product has not been damaged or spoiled.

17 Claims, 2 Drawing Sheets

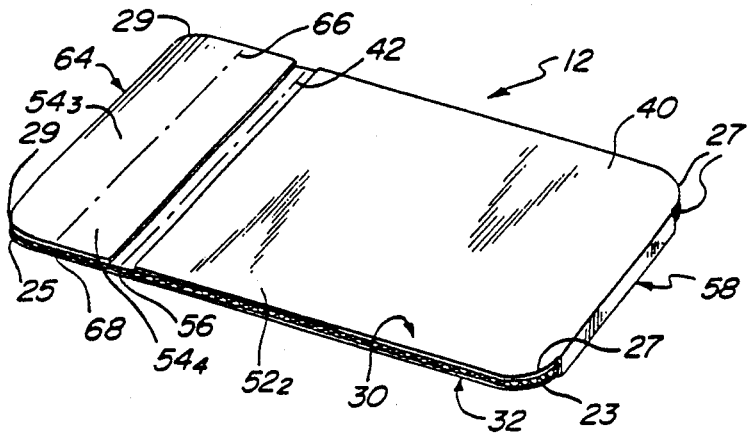
FIG. 2B
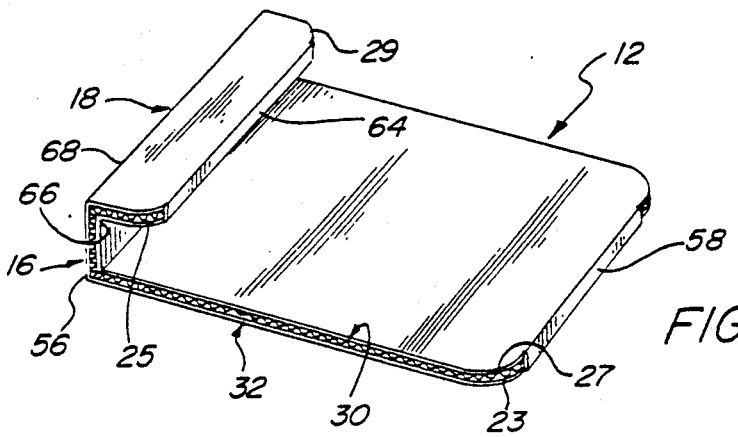
FIG. 2C
FIG. 3
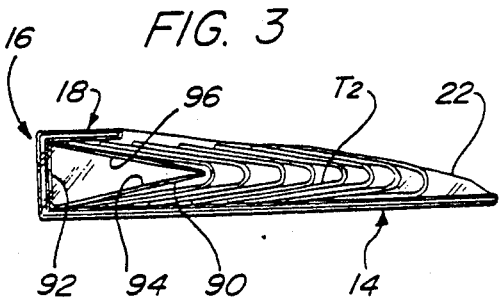
FIG. 4
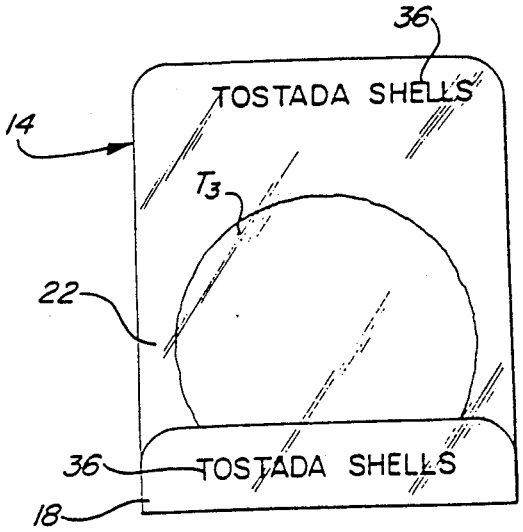

SHRINK WRAP PACKAGE FOR FRAGILE FOOD PRODUCTS

BACKGROUND OF THE INVENTION

1. Field of the Invention

The present invention generally relates to packaging for food products and, in particular, to packaging for fragile food such as tacos, tostadas and the like.

2. Description of Related Art

A long-standing problem in the food packaging industry is the packaging of brittle or fragile food products such as tortilla products in a manner sufficient to allow the product to be shipped and stored without damage. However, for tortilla products in particular, it is not sufficient to merely provide a sturdy package for preventing damage. The package should also allow for easy viewing of substantially the entire food product by a consumer prior to purchase because consumers are reluctant to purchase brittle or fragile food products unless they can easily verify that the products have not been spoiled or damaged. Further, consumers are reluctant to purchase products such as taco shells or tostada bowls without being able to verify the quantity of the product.

Several packages for tortilla products, particularly taco shells, have been provided wherein at least a portion of the product is visible to the consumer. Examples include U.S. Pat. No. 4,697,707 to Engdahl, U.S. Pat. No. 4,381,837 to Cortopassi, U.S. Pat. No. 4,018,905 to Adamek et al., and U.S. Pat. No. 4,299,850 to Wallen et al. Although the packaging structure set forth in these patents may provide improved protection of the tortilla products, a significant portion of the tortilla products are obscured from view by the packages. In particular, each packaging structure provides side walls of one form or another for enclosing and protecting the side ends of the taco shells, but which also, at least partially, obscure the side ends from view. With taco shells in particular, a likely location for chipping or damage is the outer end of the tortilla product. By obscuring the ends of the taco shells from view, either in whole or in part, customers cannot easily verify that these fragile portions of the taco shells are not damaged. Moreover, tortilla product packages such as those set forth in the exemplary patents listed above are typically formed from fairly complicated cardboard or plastic structures which require substantial manufacturing and assembly effort. In particular, these packages are formed from one or more cardboard blanks which require numerous fold lines and cut lines which require numerous steps to manufacture the blank and to later assemble the blank into a final package. The assembly steps are too complicated to allow quick and efficient assembly by hand. Moreover, the packaging structures of the exemplary patents listed above are adapted primarily, or solely, for taco shells and cannot easily be used for other tortilla products such as circular or rectangular tostada bowls or tostada shells.

Moreover, the cardboard used to assemble the packages of the prior art is often too thin to prevent the package from flexing or bending, thus allowing possible damage. Furthermore, those packages, which allow at least a partial view of the product, typically do not also allow for printed graphics and descriptions to be conveniently incorporated onto the package. Those packages, which provide adequate space for graphics, such as a basic enclosed box, typically do not allow for easy viewing of the product.

Heretofore, no adequate packaging has been developed for brittle food products such as tortilla products which not only reliably protects the brittle food product from damage, but also allows substantially the entire product to be easily viewed by a consumer, particularly side end or edge portions, and which can be easily and inexpensively manufactured and assembled.

SUMMARY OF THE INVENTION

From the foregoing, it can be appreciated that there is a need to provide an improved packaging for brittle food products such as taco shells and tostada bowls and shells. This object, and other general purposes of the invention, may be achieved by a package having a three-layer L-shaped backing assembly folded to form a flat back portion and an extending base portion for supporting a food product, with the food product and the entire L-shaped backing assembly enclosed within a transparent shrink-wrapped covering.

Preferably, the three-layer L-shaped backing assembly includes a sturdy cardboard inner layer, preferably formed of corrugated cardboard, and top and bottom thin cardboard outer layers capable of receiving printed graphics. The food product is supported against an upper surface of the flat back portion and an inner side surface of the base portion. The base portion may further include a rim extending outwardly from the base parallel with the flat back portion for providing further protection and support of the food product. With this configuration, food products, particularly tortilla products provided in a stacked, nested configuration, are sufficiently enclosed and protected to limit the possibility of damage during packaging, shipping, or storage. However, with the L-shaped configuration, most of the food product is visible through the transparent shrink wrap and opposing end portions of food products are easily viewed. This is achieved because, unlike conventional tortilla packages, no side walls obscure the end portions from view.

In a preferred embodiment, the inner sturdy cardboard layer is formed from a substantially rectangular sheet of corrugated cardboard having upper and lower portions separated by a main fold line. The outer layers of thin cardboard are formed from a single unitary, rectangular sheet also having upper and lower portions separated by a main fold line. The upper and lower portions of the thin cardboard sheet are about twice as long as the upper and lower portions, respectively, of the corrugated cardboard sheet. A pair of secondary fold lines are formed midway along the upper and lower portions of the thin cardboard sheet, parallel with the main fold line of the thin sheet. The thin cardboard sheet is folded over the inner corrugated cardboard sheet to fully enclose inner sheet. To this end, the secondary fold lines of the thin sheet are aligned with the top and bottom edges of the corrugated cardboard sheet and the main fold line of the thin sheet is aligned with the main fold line of the corrugated sheet. Portions of the thin sheet extending above and below the corrugated sheet are then folded along the secondary fold lines to enclose the inner corrugated sheet. Next, both the thin cardboard and the corrugated cardboard are folded along the main fold lines to yield the L-shaped configuration described above.

The inner corrugated cardboard provides enhanced sturdiness to prevent the package from flexing or bending in a manner which would damage the tortilla product. The outer thin cardboard layers are capable of receiving printed graphics such that colorful and enticing graphics and informative words and descriptions can be printed directly onto the package are easily viewed through the transparent shrink wrap.

Thus, a sturdy package is provided which not only reliably protects a brittle food product such as a tortilla product, but also allows easy viewing of substantially the entire product, particularly including fragile end portions. Further, the consumer can easily verify the quantity of the food product, such as the number of taco shells or tostada bowls, to verify that an adequate number is included. The package is assembled from simple thin cardboard and corrugated cardboard sections which require only simple cut lines and fold lines such that the package is inexpensively and reliably manufactured using automated equipment and inexpensively assembled by hand. Thus, no automated assembly equipment is required. However, if desired, such equipment can easily be provided. The provision of an outer thin cardboard layer capable of receiving printed graphics allows pictures and descriptions to be easily incorporated into the package and viewed through the shrink wrap. Moreover, the package is well suited to a number of convenient display arrangements. For example, the packages can conveniently be hung from a rack merely by punching a hole through a top portion of the backing assembly and through the transparent wrap adjacent to the backing assembly. Alternatively, a plurality of the packages can be shipped in a shipping carton with a perforated top portion whereby the perforated portion is removed and two or three of the topmost packages within the shipping carton are stood on their bases such that they are easily visible by consumers.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings.

Figure 1:
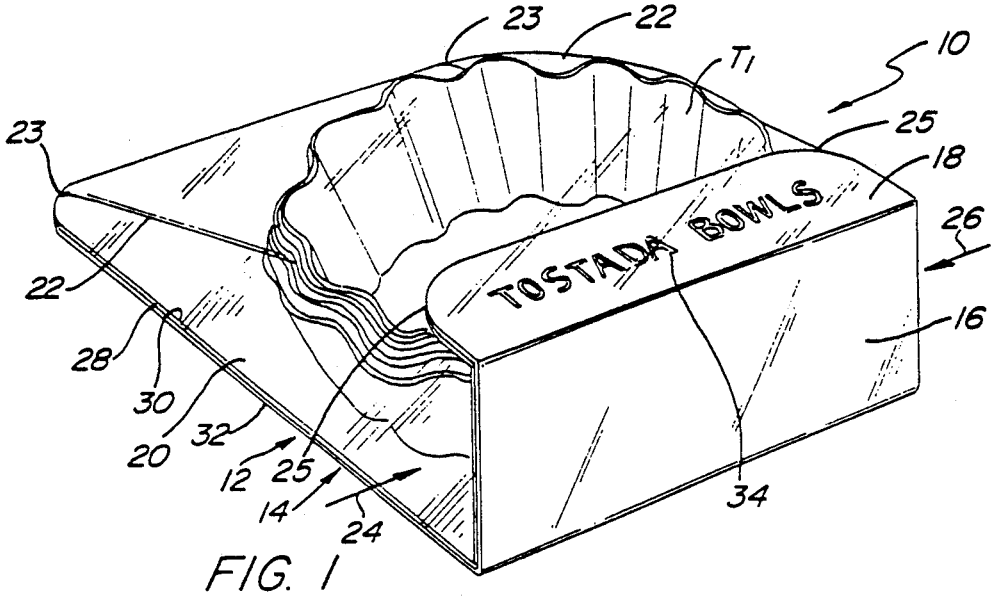
FIG. 1 provides a perspective view of a tortilla product package constructed in accordance with a preferred embodiment of the invention, shown holding a nested stack of tostada bowls.

FIGS. *2a–2c* provide a sequential illustration of the assembly of cardboard blanks used to form the food package of FIG. 1;

FIG. 3 is a side view of the food package of FIG. 1, shown holding a nested stack of taco shells; and FIG. 4 is a top view of the food package of FIG. 1, shown holding a stack of flat, disk-shaped tostada shells.

DESCRIPTION OF THE PREFERRED EMBODIMENTS

The following description is provided to enable any person skilled in the art to make and use the invention and sets forth the best modes contemplated by the inventor of carrying out his invention. Various modifications, however, will remain readily apparent to those skilled in the art, since the generic principles of the present invention have been defined herein specifically to provide a food package for packaging brittle food products such as taco shells and tostada bowls and shells.

Referring to the figures, the preferred embodiment of a package for holding food products, particularly brittle tortilla products, will now be described.

FIG. 1 provides a perspective view of a package 10 configured for holding a nested stack of tostada bowls, collectively identified by reference letter $T_1$. Package 10 includes a three-layer cardboard backing assembly 12 folded to form a flat back portion 14, an extending base portion 16, and a rim portion 18. Base portion 16 extends outwardly from a lower straight edge of back portion 14. Rim portion 18 extends outwardly, i.e., towards a top end of back portion 14, from a top straight edge of base portion 16. With this configuration, base portion 16 is generally perpendicular to back portion 14 and rim portion 18 is generally parallel with back portion 14. However, right angles need not be formed between the base portion of the back portion and between the rim portion of the base portion. Rather, the angles at which these portions are folded may deviate somewhat from 90 degrees as needed or desired to properly support and protect tortilla product $T_1$.

Tostada bowls $T_1$ are supported by backing assembly 12, with a bottom portion of a lowermost tostada shell supported by a top surface 20 of flat back portion 14. A lower outer periphery of each of the tostada shells of nested stack $T_1$ are supported by base and rim portions 16 and 18, with rim portion 18 extending over a top edge of a topmost tostada shell. A transparent shrink wrap 22 fully encloses the entire cardboard backing assembly and the nested stack of tostada bowls. Transparent shrink wrap 22 is preferably sufficiently thick and sturdy to resist tearing or bursting during ordinary storage, shipping, and handling of the package 10. Preferably, transparent shrink wrap 22 is of sufficient thickness such that it can only be opened by use of a sharp object such as a knife or by exerting considerable force with one's fingers. The sturdy and durable transparent shrink wrap not only prevents package 10 from bursting open and thereby damaging, contaminating, or spoiling food product, but also ensures that the food product is held tightly against flat base portion 14, base 16, and rim 18. In this manner, the food product is prevented from sliding or moving with respect to backing assembly 12 in a manner which could cause damage to the food product. Moreover, by holding the food product tightly within an interior space partially defined by the back portion, base portion, and rim portions, the food product is substantially protected from damage caused by impact with other packages or surfaces.

Although effectively protected from damage, a substantial portion of the tostada product $T_1$ is plainly visible through transparent shrink wrap 22 as can be seen from FIG. 1. Thus, a consumer can verify the integrity of the food product and be assured that no damage or fragmentation of the product has occurred. Moreover, a consumer can be assured that the food product has not been visibly spoiled or contaminated and is still fresh and appealing. In particular, lateral opposing side edges of the tostada bowls are completely unobscured such that these particularly fragile portions can be fully viewed by a consumer to verify that no damage has occurred. Indeed, substantially the entire food product is visible through transparent shrink wrap 22 except for a portion held under rim 18. However, even that portion can be viewed by looking sideways into the package in a direction indicated by arrow 24 or arrow 26. Thus, almost the entire outer edges of the nested tostada bowls can be conveniently viewed by a consumer prior to purchase to verify that no significant damage or spoiling has occurred.

To further prevent shrink wrap 22 from tearing or bursting, upper corners of back portion 14 and rim portion 18 are chamfered. The chamfered corners, identified by reference numerals 23 and 25, respectively, are curved to eliminate sharp corners which could puncture shrink wrap film 22.

Cardboard backing assembly 12 includes an inner corrugated cardboard sheet 28 and top and bottom thin cardboard sheets 30 and 32, respectively. As will be described more fully below with reference to FIGS. 2A-2C, top and bottom thin cardboard sheets 30 and 32 are preferably formed from a single unitary cardboard sheet which is folded over inner corrugated sheet 28. Outer thin sheets 30 and 32 are preferably formed of a thin cardboard capable of receiving colorful printed graphics. In this manner, pictures informative descriptions and other visual indicia, such as a "tostada bowl" indicia identified 34 are conveniently provided on package 10. Since shrink wrap 22 is fully transparent, all such indicia is easily viewed through the shrink wrap. As can be seen from FIG. 1, considerable surface areas on top and bottom sheets 30 and 32 are available for such graphics and indicia. In particular, almost the entire outer surfaces of top and bottom cardboard layers 30 and 32 are available for printed graphics which are unobscured to a consumer or purchaser. The entire outer surface of lower layer 32 is unobscured. Although the surface of top layer 30 is partially obscured by the presence of the food product, at least a large portion of a top end of top layer 30 is unobscured such that any graphics printed thereon are easily visible. This considerable surface area of the top and bottom layers may be conveniently used to provide product descriptions, recipes, ingredient lists, colorful pictures or graphics, or any other form of printed indicia.

Figure 2A:
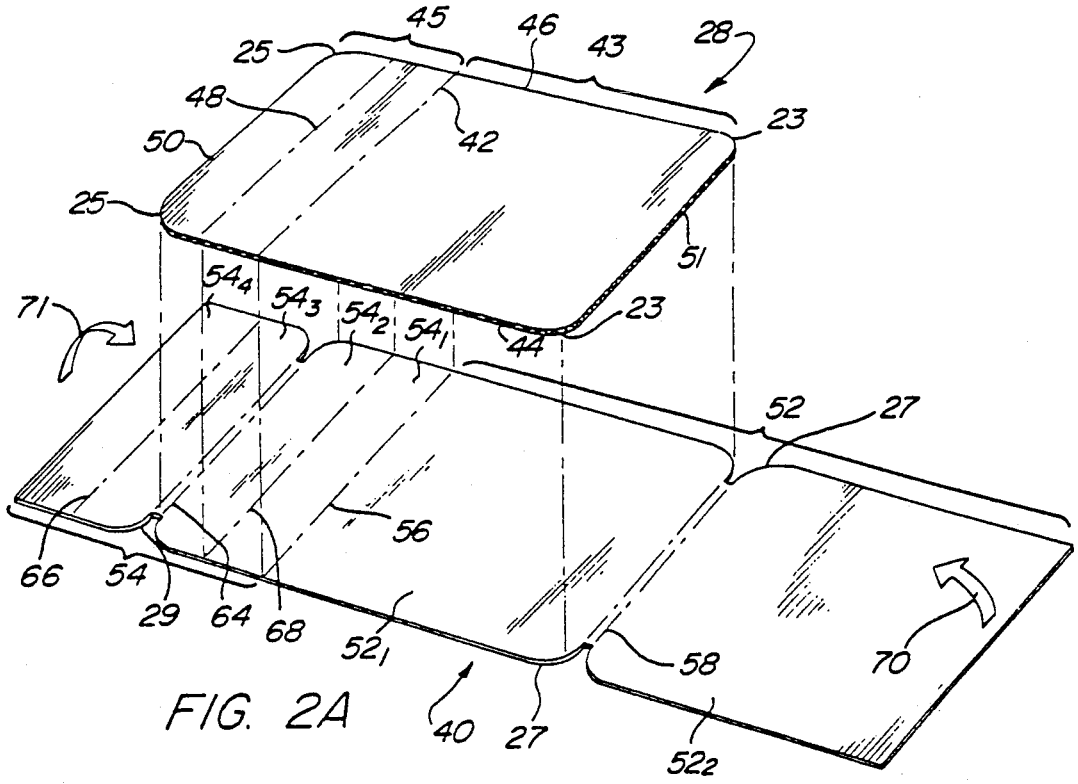

The shape of corrugated cardboard inner sheet 28 and upper and lower outer sheets 30 and 32, and the manner in which they are assembled, will now be described with reference to FIGS. 2A-2C. Upper and lower outer sheets 30 and 32 are formed from a single unitary thin cardboard sheet, identified by reference numeral 40. Inner corrugated sheet 28 is substantially rectangular other than for the provision of curved chamfered corners 23 and 25. A main fold line 42 is provided laterally along corrugated sheet 28 between opposing side edges 44 and 46. A secondary fold line 48 is provided between main fold line 42 and a bottom edge 50 of corrugated sheet 28. Bottom edge 50, secondary fold line 48, and main fold line 42, as well as a top edge 51 of the corrugated sheet, are all parallel to each other. As will be shown more clearly in FIG. 2C, the main and secondary fold lines facilitate the folding or bending of corrugated sheet 28 to form base portion 16 and rim portion 18. The portion of corrugated sheet 28 between fold line 42 and top edge 51 defines a backing portion 43. The remaining portion of sheet 28 defines a base and rim portion 45.

Unitary thin cardboard sheet 40 is likewise substantially rectangular, but has an overall length about twice the length of corrugated sheet 28. Unitary sheet 40 has upper and lower rectangular sections 52 and 54 separated by a main fold line 56. Upper portion 52 of unitary sheet 40 is subdivided by a pair of closely adjacent fold lines 58. Upper portion 52 is thus subdivided into a first portion $52_1$, and a second portion $52_2$. Each half-portion $52_1$ and $52_2$ is approximately the same size as backing portion 43 of corrugated sheet 28.

A second pair of secondary fold lines 64 subdivide lower portion 54. Lower portion 54 is thereby subdivided into two sections. Each section is further subdivided by tertiary fold lines 66 and 68, respectively. The provision of a pair of secondary fold lines 64 and tertiary fold lines 66 and 68 together subdivide lower portion 54 into a total of four separate portions identified by reference numerals $54_1$, $54_2$, $54_3$, and $54_4$.

Sections $54_1$ and $54_2$ together have approximately the same size and shape as base and rim portion 45 of corrugated sheet 28. The various fold lines are positioned and aligned, as shown, such that thin sheet 40 may be folded over corrugated sheet 28 to substantially enclose sheet 28. To this end, main fold line 42 of corrugated sheet 28 is aligned with main fold line 56 of unitary sheet 40. The pair of secondary fold lines 58 of unitary sheet 40 are aligned with bottom edge 52 of corrugated sheet 28. Likewise, the pair of secondary fold lines 64 of unitary thin sheet 40 are aligned with top edge 50 of corrugated cardboard inner sheet 28. In this manner, rectangular portion $52_2$ of unitary thin sheet 40 is folded over lower edge 52 of corrugated sheet 28, as shown by direction arrow 70, to yield the configuration of FIG. 2B. Likewise, portions $54_3$ and $54_4$ of unitary sheet 40 are folded along secondary fold line 64, as shown in direction arrow 71, to yield the configuration of FIG. 2B. Secondary fold lines 58 and 64 of unitary sheet 40 each comprise a pair of fold lines rather than a single fold line, to accommodate the thickness of corrugated sheet 28.

First and second portions $52_1$ and $52_2$ of unitary sheet 40 have chamfered inner corners 27 which are shaped to correspond to chamfered outer corners 23 of corrugated sheet 28. When folded onto corrugated sheet 28, the inner chamfered corners 27 of thin interior sheet 40 align with outer chamfered corners 23, thereby yielding the final chamfered corners of the assembled package.

Likewise, sections $54_2$ and $54_3$ of thin unitary sheet 40 are provided with similar inner chamfered corners 29, which match outer chamfered corners 25 of corrugated sheet 28. Thus, when folded onto corrugated sheet 28, the inner chamfered corners of thin unitary sheet 40 align with and match the outer chamfered corners 25 of the corrugated sheet to yield chamfered outer corners of the final package configuration.

In FIG. 2B, outer thin unitary sheet 40 is shown fully folded onto inner cardboard sheet 28. To yield the final L-shaped configuration of FIG. 2C, the sandwich structure of FIG. 2B is first folded simultaneously along main fold line 42 of corrugated sheet 28 and main fold line 56 of unitary sheet 40 to form base 16. Next, the structure is folded simultaneously along secondary fold line 48 of corrugated sheet 28 and tertiary fold lines 66 and 68 of unitary sheet 40 to form rim 18. As can be seen from FIGS. 2B and 2C, opposing end portions of unitary sheet 40 fold over corrugated sheet 28 to collectively form top layer 30. Middle sections $52_1$, $54_1$ and $54_2$ of unitary sheet 40 remain along a bottom surface of the corrugated sheet to collectively form the bottom layer 32. Once assembled to the configuration of FIG. 2C, a food product such as a tostada bowl or a stack of taco shells may be inserted into the L-shaped cardboard backing assembly 12 before the entire assembly and food product are enclosed within transparent shrink wrap 22.

The manufacture and assembly of the cardboard backing assembly 12 is fairly inexpensive and straightforward. Appropriately-sized rectangular cardboard sheets are cut, fold lines are formed at appropriate locations, and chamfered inner and outer corners are cut into the cardboard sheets. Corrugated inner sheet 28 is then placed onto unitary sheet 40 with the opposing ends of unitary sheet 40 folded to first yield the configuration of FIG. 2B, then folded again to yield the configuration of FIG. 2C. Conventional manufacturing equipment can perform the simple and inexpensive manufacturing steps required to form the blanks. Unlike conventional tortilla packages of the prior art, no complicated cardboard blank is required having numerous fold lines and difficult-to-form cutout portions. Manufacture is therefore quick and inexpensive. Assembly of the blanks into the final folded package is easily performed manually. In contrast to prior art packages, which may require numerous assembly steps of folding precut blanks and inserting tabs into precut slots, the assembly of package 10 of the invention is comparatively very simple. A worker merely places the inner cardboard sheet onto the outer sheet, then folds the sheets as described above to quickly yield a package for receiving the tortilla product. Therefore, the package is assembled quickly and efficiently such that a large number of such packages can be quickly formed using relatively few workers. Further, as assembly is quite simple, no substantial amount of teaching is required to instruct workers, as can be required with the more complicated packaging structures of the prior art. Conventional equipment is employed for forming the transparent overwrap around the package once the food product has been inserted.

If it is desired that the final package have graphics or other printed indicia, such graphics should be printed onto thin unitary sheet 40 prior to assembly with inner corrugated sheet 28. The printing of such graphics is preferably accomplished by conventional mechanisms for printing onto thin cardboard sheets. Only one surface of unitary sheet 40 need be printed on, the other surface being held against the corrugated sheet and thereby obscured from view.

Referring to FIGS. 3 and 4, package 10 is shown holding a nested stack of taco shells $T_2$ and a stack of flat tostada shells $T_3$, respectively. As with the tostada bowls shown in FIG. 1, taco shells $T_2$ and tostada shells $T_3$ are supported by flat back portion 14 and inner surfaces of base portion 16 and rim portion 18. For taco shells $T_2$, a cardboard insert 90 is preferably provided which is disposed within an innermost taco of nested taco stack $T_2$. A flat base portion 92 of insert 90 is disposed against an inner side surface of base portion 16. A pair of leaves 94, 96 extend outwardly from base 92 to form a wedge-shaped support for inserting into the innermost shell of the stack of taco shells. As with the assembly of FIG. 1, a transparent overwrap 22 is provided.

What has been described is a packaging assembly adapted for packaging brittle food products such as tortilla products in a manner in which the tortilla products are both substantially protected from damage, yet are easily visible through a transparent shrink wrap. A consumer can therefore quickly verify that the tortilla product has not been damaged or spoiled and can verify the quantity of the product. Opposing outer edges of the tortilla products are exposed to view, as these sections are most fragile and, therefore, of greatest concern to a consumer. The packing assembly includes a sturdy inner corrugated sheet enclosed within a thinner cardboard sheet. The inner corrugated sheet provides support, whereas the outer thinner sheet provides graphics pictures and informative information to the consumer. The package is easily constructed from a pair of cardboard blanks, each of which requires only minimal scoring and cutting. The blanks are folded into an L-shaped configuration with only one or two steps. Hence, the entire package can be quickly and inexpensively manufactured and assembled.

A variety of different cardboard materials may be used to form the inner corrugated layer and the outer thin cardboard layers. Further, although cardboard is preferred, the package can be assembled from a material other than cardboard, for example, a plastic material. Although shown and described with reference to certain tortilla products, the packaging assembly can be advantageously used for packaging other food products as well, in addition to nonfood products. Examples of other food products include enchilada tubes, ice cream cones, nacho chips, and the like. Examples of nonfood products include paper products, small toys, or the like.

Those skilled in the art will appreciate that various adaptations and modifications of the just-described preferred embodiment can be configured without departing from the scope and spirit of the invention. Therefore, it is to be understood that, within the scope of the appended claims, the invention may be practiced other than as specifically described herein.

What is claimed is:

1. A package containing a food product, comprising:

a three-layer L-shaped backing assembly having (1) a rigid inner layer and (2) top and bottom thin outer layers comprised of a single unitary piece of thin cardboard folded over the rigid inner layer, the outer layers capable of receiving printed graphics, the L-shaped backing assembly having a flat back portion and an extending base portion, the back and extending base portions being sized to support a portion of the food product with the back portion and a portion of the food product with the extending base portion; and a transparent shrink wrap covering the product and the backing assembly, the shrink wrap holding the product against the backing.

2. The package of claim 1, wherein an edge of the extending base portion of the backing assembly is folded to form an upwardly-extending rim, the rim being roughly parallel with the flat back portion of the backing.

3. The package of claim 2, wherein upper side corners of the flat back portion and upper side corners of the extending rim are chamfered.

4. The package of claim 3, wherein the chamfered corners are curved.

5. The package of claim 1, wherein the package contains a tortilla product.

6. The package of claim 5, wherein the tortilla product comprises a plurality of taco shells in a nested configuration.

7. The package of claim 6, wherein the package further includes a cardboard wedge insert, the insert having a flat base disposed against the extending base portion and an angled portion extending into a an innermost one of the nested taco shells for supporting the taco shells to prevent the taco shells from breaking and to maintain the shape of the taco shells.

8. The package of claim 5, wherein the tortilla product comprises a plurality of tostada bowls in a nested configuration.

9. The tortilla product of claim 5, wherein the tortilla product comprises a plurality of disk-shaped tostada shells in a stacked configuration.

10. The package of claim 1, wherein the inner rigid layer is corrugated cardboard.

11. The package of claim 1, wherein:

the rigid inner layer is formed from a rectangular sheet having a top edge and a bottom edge with upper and lower rectangular portions therebetween separated by a main fold line, the lower portion being folded along the main fold line of the inner corrugated layer to extend outwardly from the upper portion to form the base portion of the L-shaped assembly; wherein the outer layers of thin cardboard are formed from a single unitary rectangular sheet having upper and lower rectangular portions separated by a primary fold line, the upper and lower portions of the thin cardboard sheet being about twice as long as the upper and lower portions, respectively, of the corrugated cardboard sheet, with a pair of secondary fold lines formed midway along the lower portion of the thin cardboard sheet, the secondary fold lines of the thin sheet being parallel with the primary fold line of the thin sheet; and wherein the thin sheet is folded over the rigid inner layer with the secondary fold lines of the thin sheet being aligned with and folded over the top and bottom edges of the rigid inner layer, respectively, and with the primary fold line of the thin sheet aligned with the main fold line of the rigid inner sheet, the thin sheet thereby covering the entire surface of the rigid inner sheet with the top and bottom edges of the corrugated sheet being enclosed.

12. The package of claim 11, wherein an edge of the extending base portion is folded along a tertiary fold line to form an upwardly-extending rim portion, the rim portion being roughly parallel with the flat back portion, with both the rigid inner sheet and the thin sheet being folded to yield the tertiary fold line.

13. A package containing a food product comprising:

an internal support sheet having a front side, a back side, an upper end, and a lower end;

a first fold line located horizontally on said support sheet between the upper and lower ends, said first fold line dividing said support sheet into a vertical support back and a horizontal support shelf, the horizontal support shelf protruding perpendicularly from the front side of the vertical support back along the first fold line to form a first inside corner, a space adjacent to the front side of the horizontal support shelf and to the front side of the vertical support back defining a protective support space for the food product;

a cover sheet being thinner than said support sheet and having an inner surface, an outer surface, a top end, and a bottom end, the outer surface of said cover sheet being suitable for receiving and bearing printed matter related to the food product;

a primary fold line located horizontally on said cover sheet between the top and bottom ends, said primary fold line dividing said cover sheet into an upper portion and a lower portion, the upper portion being about twice as long as the vertical support back and the lower portion being about twice as long as the horizontal support shelf;

said cover sheet being located adjacent to said support sheet with the inner side and the primary fold line of said cover sheet located adjacent to the back side and the first fold line of said support sheet;

the upper and lower portions of said cover sheet being folded respectively around the vertical support back and the horizontal support shelf to form three layers, the inner surface of said cover sheet facing the front and back sides of said support sheet, the matter printed on the outer surface of said cover sheet being exposed away from both the front and back sides of the support sheet; and a transparent shrink wrap securing the food product in the protective support space while visually exposing the food product and the matter printed on the outer surface of said cover sheet, thereby providing a package which protects the food product, is visually informative as to a condition of the food product, and is attractive for viewing by a prospective purchaser.

14. The package of claim 13 wherein the top end of said cover sheet and the bottom end of said cover sheet meet in the protective support space adjacent to the first inside corner of said support sheet, the food product secured in the protective support space securing the top and a bottom ends of said cover sheet to said support sheet.

15. The package of claim 13 further comprising:

a second fold line located horizontally on said support sheet between the first fold line and the lower end of said support sheet, said second fold line dividing the horizontal support shelf into a horizontal shelf portion and a vertical lip portion, the vertical lip portion protruding vertically upward from the horizontal shelf portion along the second fold line to form a second inside corner.

16. The package of claim 15 further comprising:

a pair of secondary fold lines located horizontally on the lower portion of said cover sheet between the primary fold line and the bottom end of said cover sheet so that, when the lower portion of said cover sheet is folded around the horizontal shelf portion and the vertical lip portion of said support sheet, a first one of said pair of secondary fold lines being located adjacent to the second fold line on the front side of said support sheet and a second one of said pair of secondary fold lines being located adjacent to the second fold line on the back side of said support sheet.

17. The package of claim 16 wherein the top end of said cover sheet and the bottom end of said cover sheet meet in the protective support space adjacent to the first inside corner of said support sheet, the food product secured in the protective support space securing the top and bottom ends of said cover sheet to said support sheet.

* * * * *